United States Patent [19]

Ichida et al.

[11] Patent Number: 4,519,879

[45] Date of Patent: May 28, 1985

[54] METHOD OF PRODUCING TIN-FREE STEEL SHEETS

[75] Inventors: Toshio Ichida; Hideo Kobayashi; Hajime Ogata; Shunichi Tsugawa, all of Chiba, Japan

[73] Assignee: Kawasaki Steel Corporation, Hyogo, Japan

[21] Appl. No.: 498,548

[22] Filed: May 26, 1983

[30] Foreign Application Priority Data

Jun. 1, 1982 [JP] Japan ..... 57-93414

[51] Int. Cl.[3] ..... C25D 5/00; C25D 5/48

[52] U.S. Cl. ..... 204/35.1; 204/28; 204/41; 204/51; 204/56 R; 204/38.1; 204/38.3

[58] Field of Search ..... 204/23, 27, 41, 51, 204/28, 35.1, 38 R, 38 A, 56 R

[56] References Cited

U.S. PATENT DOCUMENTS

| | | | |
|---|---|---|---|
| 3,421,986 | 1/1969 | Ruff et al. | 204/36 |
| 3,928,157 | 12/1975 | Suematsu et al. | 204/181 |
| 3,986,940 | 10/1976 | Takano et al. | 204/28 |
| 4,145,263 | 3/1979 | Tsutsui et al. | 204/35 R |
| 4,157,944 | 6/1979 | Inui et al. | 204/41 |
| 4,296,182 | 10/1981 | Matsubayashi et al. | 428/629 |
| 4,432,845 | 2/1984 | Ogata et al. | 204/35.1 |

FOREIGN PATENT DOCUMENTS

| | | | |
|---|---|---|---|
| 57-177998 | 11/1982 | Japan | 204/35.1 |
| 1511946 | 5/1978 | United Kingdom . | |

*Primary Examiner*—T. Tung

*Attorney, Agent, or Firm*—Young & Thompson

[57] ABSTRACT

Tin-free steel sheets having improved resistance to retorting treatment are produced by chromium plating a steel sheet through cathodic electrolysis in a chromium ion-containing aqueous solution to form a metallic chromium coating, reversely electrolyzing the chromium plated steel sheet by a successive anodizing treatment in the same solution, and subjecting the sheet to an electrolytic chromate treatment in another aqueous solution of chromic acid, a chromate or dichromate. The chromium plating and reverse electrolysis should be carried out so as to satisfy the equations:

$$x+1 \leqq y \leqq x+4$$

$$1 \leqq x \leqq 6$$

where y and x are the quantities of hydrated chromium oxides present on one surface of the steel sheet after the chromium plating step and after the reverse electrolysis step, respectively, as expressed in mg (in terms of metallic chromium) per square meter of the surface.

2 Claims, 5 Drawing Figures

METHOD OF PRODUCING TIN-FREE STEEL SHEETS

BACKGROUND OF THE INVENTION

This invention relates to a method of producing tin-free steel sheets having improved retorting resistance, and more particularly, to a method of producing electrolytic chromate treated steel sheets having improved retorting resistance as the bonded can-forming material.

Electrolytic chromate treated steel sheets also known as tin-free steel (TFS) of chromium type have improved properties as can-forming material and are regarded as a substitute for tin plates, and the demand for them is increasing in recent years.

Since TFS has metallic chromium and hydrated chromium oxide coatings on the surface, it does not possess sufficient weldability. A can is fabricated from a TFS sheet by bonding the mating edges of a blank with a polyamide adhesive to form a can barrel.

Recently, the extent of application of TFS cans has been further spread. That is, TFS cans are not only used for low-temperature packs prepared by packing contents such as carbonated beverage and beer in cans at relatively low temperatures, but also used for the so-called hot packs prepared by packing contents such as fruit juice and coffee in cans at relatively high temperatures for sterilization. TFS is also used in those cans requiring a high temperature retorting treatment for sterilization at the end of packing. In the latter applications, there often occurred accidents of rupture of can barrels.

This can barrel rupture occurs in bonded TFS cans during hot packing and retoring treatment because hot water penetrates through the polyamide resin layer to deteriorate the interfacial adhesion between the paint film and the TFS substrate to eventually separate the paint film from the TFS.

Research has revealed that sulfuric acid, which was conventionally added to chromium plating baths and electrolytic chromic acid baths, was codeposited in the hydrated chromium oxide coating and this sulfuric acid codeposited was dissolved out during the retorting treatment to give rise to the paint film-TFS substrate interfacial separation. Several proposals were made to avoid sulfuric acid codeposition, for example, by using sulfuric acid-free plating bath, or by eliminating sulfuric acid from an acid pickling solution used in a pre-treatment. However, these techniques had a number of industrial problems in that manufacture efficiency is considerably lowered, product quality is less consistent, and yield is low as compared with the traditional techniques.

It is, therefore, an object of the present invention to eliminate the above-mentioned problems of the prior art and to provide an improved method of producing tin-free steel sheets which do not undergo any interfacial separation between TFS and a paint film during a retorting treatment.

The inventors previously proposed in Japanese Patent Application No. 56-62766 a technique capable of overcoming the problem of sulfuric acid codeposition wherein chromium plating is followed by a reverse electrolysis treatment of anodizing the plated steel sheet in the chromium plating bath solution, and then by an electrolytic chromate treatment in an aqueous chromic acid solution.

Continuing further research, the inventors have found that while the previous method of inserting between the chromium plating step and the electrolytic chromate treatment a reverse electrolysis step of anodizing the plated steel sheet is very effective in improving the retorting resistance of the steel sheet, the best quality is obtained only by a proper choice of the extent of the reverse electrolysis treatment, and this proper extent of the reverse electrolysis treatment can be achieved only by a proper choice of conditions such that the quantities of hydrated chromium oxides present on the steel sheet surface before and after the reverse electrolysis may satisfy a certain relationship.

SUMMARY OF THE INVENTION

According to the present invention, there is provided a method of producing a tin-free steel sheet having improved retorting resistance, comprising chromium plating a steel sheet through cathodic electrolysis in a chromium ion-containing aqueous solution to form a plating consisting essentially of metallic chromium, reversely electrolyzing the chromium plated steel sheet by a successive anodizing treatment in said aqueous solution, and subjecting the reversely electrolyzed steel sheet to an electrolytic chromate treatment in another aqueous solution of at least one member selected from the group consisting of chromic acid, chromates, and dichromates, the improvement wherein said chromium plating and reverse electrolysis steps are carried out so as to satisfy the equations:

$$x+1 \leqq y \leqq x+4 \quad (1)$$

$$1 \leqq x \leqq 6 \quad (2)$$

where y and x are the quantities of hydrated chromium oxides present on the surface of the steel sheet after the chromium plating step and after the reverse electrolysis step, respectively, as expressed in mg (in terms of metallic chromium) per square meter of the surface.

BRIEF DESCRIPTION OF THE DRAWINGS

The above and other objects, features and advantages of the invention will be more fully understood by reading the following description in conjunction with the accompanying drawings, in which.

DETAILED DESCRIPTION OF THE INVENTION

Figure 1:
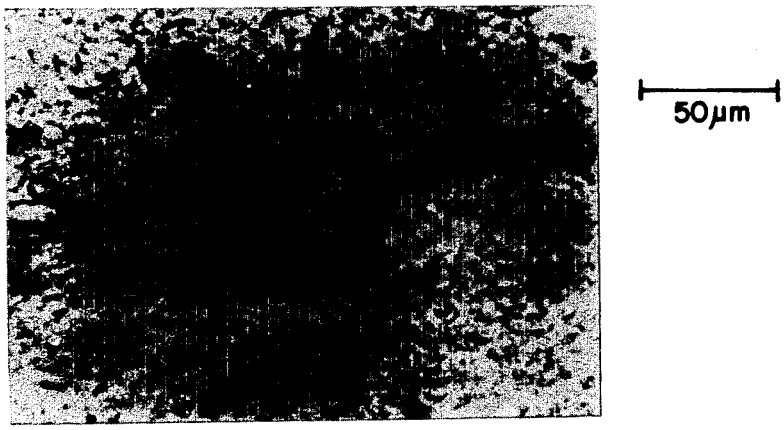
FIG. 1 is a microscopic view of a smooth TFS surface.

The present invention is directed to TFS sheets having a plating of metallic chromium ranging from 50 to 200 mg per square meters on each sheet surface and a coating of hydrated chromium oxides ranging from 5 to 30 mg per square meter on the metallic chromium plating surface. TFS sheets generally have a metallic chromium plating of 50–200 mg/m$^2$ because thinner platings of less than 50 mg/m$^2$ have poor corrosion resistance. Thicker platings exceeding 200 mg/m$^2$ are not expected to provide an additional improvement in corrosion resistance.

TFS sheets have a coating of hydrated chromiunm oxides of 5–30 mg/m$^2$ because thinner coatings of less than 5 mg/m$^2$ do not provide the necessary paint adhesion. Thicker coatings exceeding 30 mg/m$^2$ have a poor appearance and are prone to cracking during subsequent processing and thus impractical. The most desirable range is 8–25 mg/m$^2$.

The chromium plating bath and electrolytic chromate bath used in TFS manufacture are basically aqueous solutions of chromic acid, a chromate or a dichromate, to which a variety of assistants are added. Most of these assistants contain one or more anions such as sulfate and fluoride ions, and such anions are codeposited in a substantial proportion in hydrated chromium oxide coatings formed on the TFS surface. Particularly, the sulfate residue codeposited in the coating is detrimental because it can be dissolved out during a retorting treatment of bonded TFS cans to give rise to paint film-TFS interfacial separation as described earlier.

The quantities of metallic chromium and hydrated chromium oxides deposited on the steel sheet surface at the end of chromium plating vary over a wide range with the electrolyte concentration, amount of assistants added, temperature, plating line speed or plating time, current density and other factors. On the steel sheet surface, metallic chromium forms a lower layer and hydrated chromium oxides form an upper layer having assistant anions such as sulfate residue codeposited. The water-soluble, particularly detrimental sulfate residue is present concentratedly in that portion of the hydrated chromium oxide coating which is at or near the surface.

The chromium plated steel sheet is subjected to a reverse electrolysis treatment, for example, at 15 A/cm$^2$ for 0.2 sec. while it serves as an anode. It is then adjusted for adequate combination of metallic chromium and hydrated chromium oxide by an electrolytic chromate treatment. The resulting TFS sheets are inconsistent with respect to surface coating uniformity and retorting resistance, and good results are not always obtained.

The inventors carried out the following basic experiment in order to find adequate conditions for the reverse electrolysis to assure that the resulting TFS sheets always show excellent retorting resistance.

Steel sheets were cathodically treated in aqueous chromic acid solutions containing 30–400 g/l of chromic acid as well as sulfuric acid and other assistants while bath temperature, electrolyzing time, and current density were changed so as to deposit 100–130 mg/m$^2$ of metallic chromium and 1.5–12 mg/m$^2$ (in terms of chromium) of hydrated chromium oxide. While the chromium plated steel sheets were set as an anode in the same aqueous solution, they were successively subjected to a reverse electrolysis treatment with varying current density and electrolysis time. The quantity of hydrated chromium oxides formed on the surface was measured. After the reverse electrolysis, the steel sheets were further subjected to an electrolytic chromic acid treatment in an aqueous solution containing at least one of chromic acid and chromates and an unavoidable amount of sulfuric acid compound to adjust the quantity of hydrated chromium oxides to 15±3 mg/m$^2$.

Figure 2:
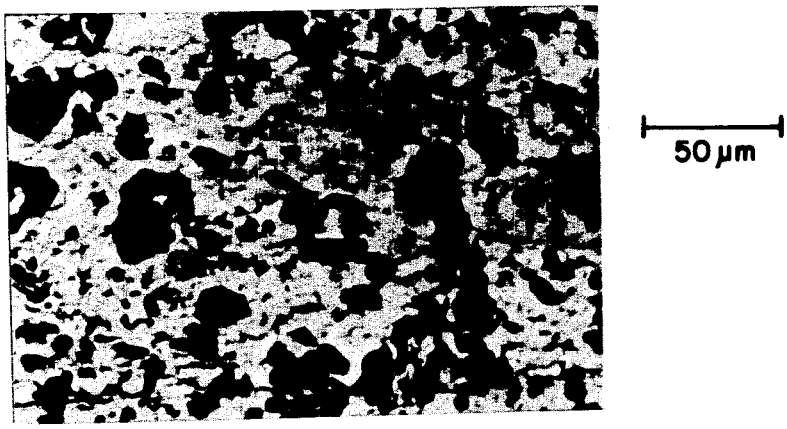
FIG. 2 is a microscopic view of an irregular TFS surface.
Figure 3:
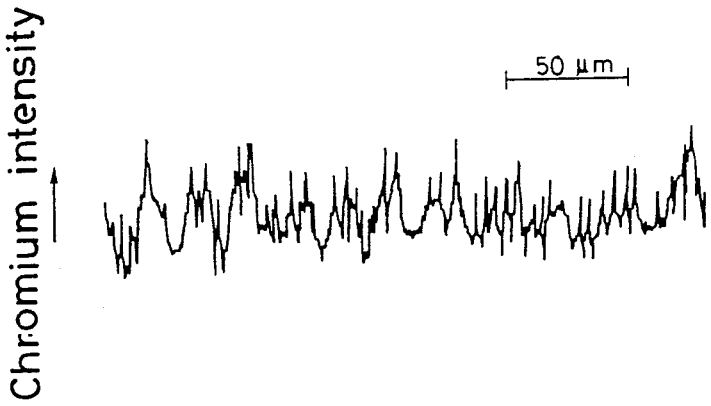
FIG. 3 shows the result of analysis of Cr by EPMA on the smooth TFS surface.
Figure 4:
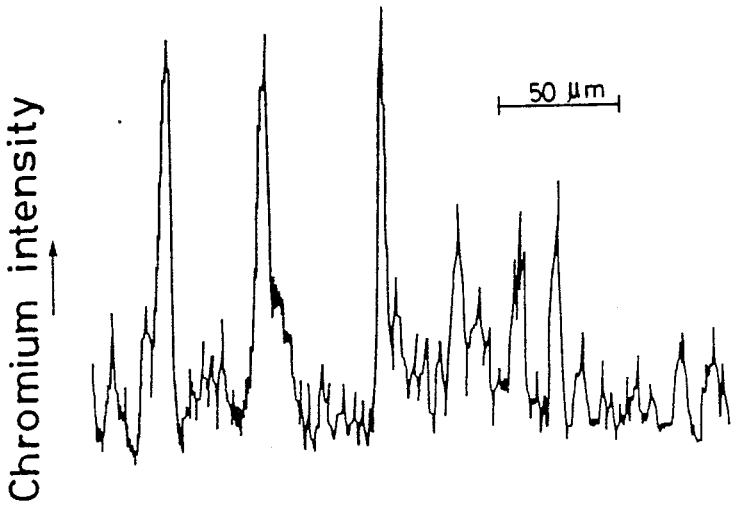
FIG. 4 shows the result of analysis of Cr by EPMA on the irregular TFS surface.

The surface of the thus obtained TFS sheets was observed under an optical microscope with 400X magnification. Some sheets showed a uniform or smooth surface as shown in FIG. 1 while the remaining sheets showed an irregular surface full of black spots as shown in FIG. 2. The hydrated chromium oxide coatings on the TFS sheets were collected by electrolytic separation in a Nital etchant and analyzed for chromium by means of an X-ray microanalyzer. The results of analysis are shown in FIGS. 3 and 4. In the case of the black spotfree TFS sheet as shown in FIG. 1, the chromium concentration varies over a narrow range as shown in FIG. 3. In the case of the black spotted TFS sheet as shown in FIG. 2, the chromium concentration is locally peaked as shown in FIG. 4, which indicates that the irregularities appearing as black spots are due to a difference in concentration of hydrated chromium oxides.

In order to examine the paint adhesion and retorting resistance of TFS sheets, a T-peel test was performed. A TFS sheet was coated with an epoxyphenol resin paint or "size coated" on one surface to a paint film quantity of 50±5 mg/dm$^2$ and baked at 190° C. for 10 minutes, and then coated with another epoxyphenol resin paint or "gold coated" on the other surface to the same paint film quantity and baked at 210° C. for 10 minutes.

Thereafter, an adhesive synthetic resin (nylon) tape (100 μm thick, 5 mm wide) was sandwiched between the size coated surface of one sheet and the gold coated surface of another sheet. The sandwich was pressure bonded by a hot press at 190° C. and 1 kg/cm$^2$ for about 30 seconds, obtaining a test piece. Immediately after press bonding, the test piece was measured for peel strength by carrying out a T-peel test using an Instron tensile tester at a constant rate of pulling of 200 mm/min.

Another test piece was immersed in an acidic sugar solution containing 15 g/l of sucrose and adjusted to pH 3.3 with citric acid at 90° C. for 7 days, before a T-peel test was carried out on the piece in a similar manner. In each test, measurement was made on five test pieces to determine an average.

The measurement of a T-peel test immediately after bonding represents the degree of adhesion of a paint film while the measurement of another T-peel test after immersion in an acidic sugar solution at 90° C. for 7 days shows how the adhesive force between the paint film and the hydrated chromium oxide coating is changed after a retorting treatment, typically high-temperature sterilization, and thus represents the retorting resistance.

The peel strength immediately after bonding was higher than 5 kg/5 mm for all the test pieces and thus satisfactory. The peel strength of test pieces after immersion in an acidic sugar solution at 90° C. for 7 days varied from 0.3 kg/5 mm to 3.9 kg/5 mm depending upon the TFS test piece preparation conditions, indicating a difference in retorting resistance.

Figure 5:
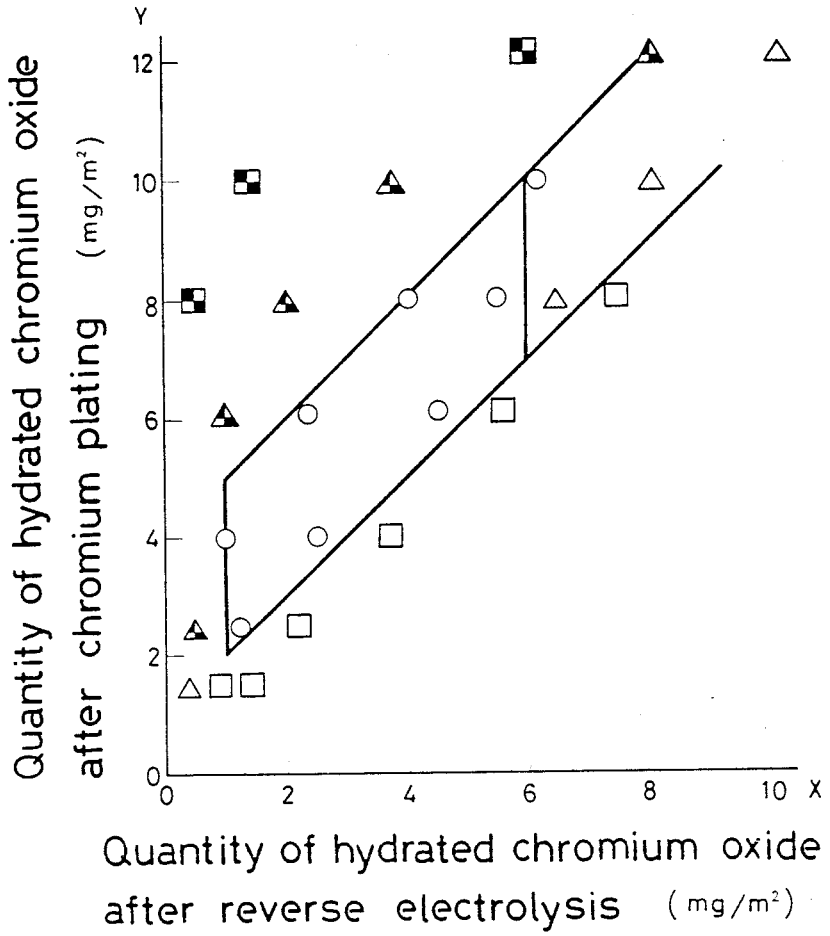
FIG. 5 is a diagram showing the coating irregularity and T-peel test strength in relation to the quantities of hydrated chromium oxides before and after reverse electrolysis.

FIG. 5 shows the presence of absence of irregularities in the hydrated chromium oxide coating and the peel strength after immersion in an acidic sugar solution for 7 days in relation to the quantities of hydrated chromium oxide on the surface after chromium plating and after reverse electrolysis. Marks used in FIG. 5 have the meanings defined in Table 1.

TABLE 1

| Peel strength after immersion in acidic sugar solution at 90° C. for 7 days | Hydrated chromium oxide surface under optical microscope | |
|---|---|---|
| | Smooth | Irregular |
| less than 0.5 kg/5 mm | □ | ■ |
| 0.5–1 kg/5 mm | Δ | ▲ |
| 2–4 kg/5 mm | ○ | — |

In FIG. 5, y on the ordinate represents the quantity of hydrated chromium oxides present after the chromium plating step and x on the abscissa represents the quantity of hydrated chromium oxides present after the reverse electrolysis step, both as expressed in mg (in terms of metallic chromium) per square meter of the surface. In a region located adjacent the line $y=x$ on its side toward axis y, that is, when the reverse electrolysis is effected to a less extent, no coating irregularity is observed, but the high-temperature water resistance of the bond is low. When treatments are made under conditions of the region bounded between $y=x+1$ and $y=x+4$ and satisfying the equation $1 \leqq x \leqq 6$, there is observed no coating irregularity and the high-temperature water resistance is high. When treatments are made under conditions of the region exceeding $y=x+4$, coating irregularities appear and the high-temperature water resistance becomes worse as the conditions are further shifted therefrom.

On the basis of the above-mentioned basic experiment, the conditions for ensuring the manufacture of TFS sheets free of coating irregularities and having improved retorting resistance are given by the equations:

$$x+1 \leqq y \leqq x+4 \quad (1)$$

$$1 \leqq x3 \leqq 6 \quad (2)$$

for the chromium plating and reverse electrolysis steps, wherein y and x represent the quantities of hydrated chromium oxides present after the chromium plating step and after the reverse electrolysis step, respectively, as expressed in mg (in terms of metalic chromium) per square meter of the surface.

It will be interpreted as follows that the optimum range must be met by the quantity of hydrated chromium oxides remaining after the reverse electrolysis treatment. When the reverse electrolysis treatment is carried out, the hydrated chromium oxide coating which has been formed on the surface by the preceding chromium plating step is gradually oxidized into $Cr^{6+}$ and dissolved from its surface, reducing the surface layer having a concentrated sulfate residue.

When the reverse electrolysis is insufficient, that is, when the reverse electrolysis is effected under conditions approximating to $y=x$ in FIG. 5, the sulfate residue concentrated surface layer is insufficiently dissolved and removed, resulting in poor high-temperature water resistance.

The high-temperature water resistance is reduced when the quantity of hydrated chromium oxide present after the reverse electrolysis treatment exceeds 6 $mg/m^2$, in spite of y falling within the range of $x+1 \leqq y \leqq x+4$, because it means that a substantial thickness of hydrated chromium oxide coating is formed after the chromium plating step, residues are codeposited to a considerable depth in the interior of the hydrated chromium oxide coating, and these deeply codeposited sulfuric residues are not removed by the subsequent reverse electrolysis treatment.

On the other hand, when the treatments are made under conditions exceeding $y=x+4$, that is, when the reverse electrolysis treatment is excessive, the dissolution and removal of the hydrated chromium oxide coating by anodization occur non-uniformly in proportion to the irregularities in the coating itself, resulting in a non-uniform distribution of hydrated chromium oxides, which could not be adjusted for by the subsequent chromic acid treatment. As a result, there is obtained a TFS sheet having a non-uniform hydrated chromium oxide coating. Such a TFS sheet exhibits poor retorting resistance due to the reduced resistance of thin portions of the oxide coating.

The limiting conditions defined by $x+1 \leqq y \leqq x+4$ and $1 \leqq x \leqq 6$ define the region in which the detrimental layer of hydrated chromium oxide coating is dissolved and removed to a sufficient extent to ensure sufficient removal of the layer with sulfate residue concentrated therein and uniform dissolution of the hydrated chromium oxide coating.

In the practice of the invention, the electrolytic solution used in the chromium plating may be a common chromium plating solution which contains 30–400 g per liter of at least one member selected from the group consisting of chromic acid, chromates and dichromates, and commonly used assistants such as sulfuric acid and fluorides as well as any other additives.

The reverse electrolysis is economically carried out in the chromium plating bath subsequent to the chromium plating although it may be carried out in another bath in a separate tank, if desired for convenience of system arrangement.

The electrolytic chromate treatment may be carried out in a bath containing 10–200 g per liter of at least one member selected from the group consisting of chromic acid, chromates and dichromates as expressed in terms of chromic acid. Sulfuric acid is not intentionally added while assistants such as fluorides may be blended in the chromate bath.

By properly choosing the chromium plating conditions, reverse electrolysis conditions, and electrolytic chromate treatment conditions, particularly the conditions of the former two steps within the limitation by the present invention such that the final metallic chromium may range from 50 to 200 $mg/m^2$, and the final hydrated chromium oxide may range from 5 to 30 $mg/m^2$, more preferably from 8 to 25 $mg/m^2$, there are produced tin-free steel sheets having improved retorting resistance.

EXAMPLE

A cold rolled steel sheet designated T4CA having a thickness of 0.22 mm ws electrolytically degreased in a 5% homezarine solution at 80° C., rinsed with water, immersed in a 10% $H_2SO_4$ for 5 seconds, and rinsed again with water before it was subjected to treatment in the following sequence: (A) chromium plating step→(B) reverse electrolysis step→(C) electrolytic chromate treatment. Steps (A) and (B) were succesively carried out in the same electrolytic bath. Cold water rinsing and hot water rinsing were carried out both between steps (B) and (C) and at the end of step (C).

Conditions used in the respective steps are shown in Table 2. Four different conditions were used for each of the chromium plating, reverse electrolysis and electrolytic chromate treatment.

TFS sheets were produced by carrying out the treatments under various combinations of these conditions. The quantity of metallic chromium on the steel sheet surface after the chromium plating, the quantity of hydrated chromiunm oxides on the steel sheet surface at the end of each step were determined, the hydrated chromium oxide coating was observed for surface irregularity under an optical microscope, and T-peel tests were carried out immediately after painting and after immersion in an acidic sugar solution containing 15 g/l of sucrose and adjusted to pH 3.3 with citric acid at 90° C. for 7 days. The results are shown in Table 2.

TABLE 2

| Specimen No. | | Electrolytic treatment conditions: Chromium plating | Reverse electrolysis | Electrolytic chromate treatment | Metallic chromium after chromium plating mg/m$^2$ |
|---|---|---|---|---|---|
| 1 | Comparison | $CrO_3$ 80 g/l | 5 A/dm$^2$, 0.2 sec. | $CrO_3$ 60 g/l | 120 |
| 2 | Invention | $H_2SO_4$ 0.8 g/l | 10 A/dm$^2$, 0.3 sec. | $Na_2Cr_2O_7$ 10 g/l | |
| 3 | Comparison | 50° C., 60 A/dm$^2$, | 30 A/dm$^2$, 1 sec. | 40° C., 15 A/dm$^2$, | |
| 4 | Comparison | 1.2 sec. | omitted | 1 sec. | |
| 5 | Comparison | $CrO_3$ 80 g/l | 5 A/dm$^2$, 0.2 sec. | $CrO_3$ 60 g/l | |
| 6 | Invention | $H_2SO_4$ 0.8 g/l | 10 A/dm$^2$, 0.3 sec. | 40° C., 15 A/dm$^2$, | |
| 7 | Comparison | 50° C., 60 A/dm$^2$, 1.2 sec. | 30 A/dm$^2$, 1 sec. | 1 sec. | |
| 8 | Comparison | kept immersed for further 1 sec. | omitted | | |
| 9 | Comparison | $CrO_3$ 250 g/l | 2 A/dm$^2$, 0.2 sec. | $CrO_3$ 60 g/l | 110 |
| 10 | Invention | $H_2SO_4$ 2.5 g/l | 5 A/dm$^2$, 0.2 sec. | $Na_2Cr_2O_7$ 10 g/l | |
| 11 | Comparison | 55° C., 50 A/dm$^2$, | 30 A/dm$^2$, 1 sec. | 40° C., 30 A/dm$^2$, | |
| 12 | Comparison | 1.5 sec. | omitted | 1 sec. | |
| 13 | Comparison | $CrO_3$ 250 g/l | 2 A/dm$^2$, 0.2 sec. | $CrO_3$ 60 g/l | |
| 14 | Invention | $H_2SO_4$ 2.5 g/l | 5 A/dm$^2$, 0.2 sec. | 40° C., 30 A/dm$^2$ | |
| 15 | Comparison | 55° C., 50 A/dm$^2$, 1.5 sec. | 30 A/dm$^2$, 1 sec. | 1 sec. | |
| 16 | Comparison | kept immersed for further 1 sec. | omitted | | |

| Specimen No. | | Hydrated chromium oxide on steel surface after, mg/m$^2$: Chromium plating | Reverse electrolysis | Electrolytic chromate treatment | Coating performance on TFS sheets: Coating irregularity under microscope | Bond strength by T-peel test, kg/5 mm: Immediately after bonding | After 7 day immersion in acidic sugar solution |
|---|---|---|---|---|---|---|---|
| 1 | Comparison | 10 | 8 | 16 | smooth | 5.1 | 0.6 |
| 2 | Invention | 10 | 6 | 15 | smooth | 6.2 | 3.8 |
| 3 | Comparison | 10 | 4 | 13 | irregular | 5.6 | 0.7 |
| 4 | Comparison | 10 | — | 18 | smooth | 4.2 | 0.1 |
| 5 | Comparison | 8 | 7 | 16 | smooth | 5.3 | 0.7 |
| 6 | Invention | 8 | 5 | 14 | smooth | 5.9 | 3.5 |
| 7 | Comparison | 8 | 2 | 12 | irregular | 5.1 | 0.6 |
| 8 | Comparison | 8 | — | 18 | smooth | 4.4 | 0.2 |
| 9 | Comparison | 6 | 5.5 | 17 | smooth | 5.3 | 0.3 |
| 10 | Invention | 6 | 3 | 15 | smooth | 6.5 | 3.1 |
| 11 | Comparison | 6 | 1 | 13 | irregular | 5.5 | 0.6 |
| 12 | Comparison | 6 | — | 18 | smooth | 4.8 | 0.2 |
| 13 | Comparison | 3 | 2.5 | 15 | smooth | 5.5 | 0.2 |
| 14 | Invention | 3 | 1.5 | 14 | smooth | 6.4 | 3.6 |
| 15 | Comparison | 3 | 0.5 | 12 | irregular | 5.2 | 0.7 |
| 16 | Comparison | 3 | — | 16 | smooth | 4.0 | 0.3 |

As seen from Table 2, specimens Nos. 2, 6, 10 and 14 satisfying the requirement of the present invention were free of coating irregularity and exhibited high bond strength in the T-peel tests, indicating superior retorting resistance.

For specimens of the comparative examples whose x and y values lying outside the scope of the requirement of the present invention are underlined, the bond strength after immersion in an acidic sugar solution is low and the retorting resistance is thus short.

According to the present invention, tin-free steel sheets having improved retorting resistance are produced by controlling the chromium plating and reverse electrolysis steps such that the quantity of hydrated chromium oxides on the steel sheet surface may satisfy the specific requirement.

What is claimed is:

1. A method of producing a tin-free steel sheet having improved retorting resistance, comprising:

chromium plating a steel sheet through cathodic electrolysis in a chromium ion-containing first aqueous solution that contains sulfur, to form a plating of metallic chromium with a superposed layer of hydrated chromium oxides, reducing the sulfur in said layer of hydrated chromium oxides by reversely electrolyzing the chromium plated steel sheet by a successive anodizing treatment in the same said aqueous solution, and subjecting the reversely electrolyzed steel sheet to cathodic electrolysis in a second aqueous solution of at least one member selected from the group consisting of chromic acid, chromates, and dichromates, said second aqueous solution containing substantially less sulfur than said first aqueous solution, until a layer of hydrated chromium oxides of substantial thickness has added to the layer of hydrated chromium oxides remaining after said reverse electrolyzing and the total quantity of hydrated chromium oxides is 5 to 30 mg in terms of metallic chromium per square meter of the surface, said chromium plating and reverse electrolysis being carried out so as to satisfy the equations $$x+1 \leqq y \leqq x+4$$

$$1 \leqq x \leqq 6$$

where y and x are the quantities of hydrated chromium oxides present on one surface of the steel sheet after the chromium plating step and after the reverse electrolysis step, respectively, as expressed in mg of metallic chromium per square meter of the surface.

2. A method as claimed in claim 1, in which said second aqueous solution is substantially free of sulfur.

* * * * *